US005301645A

United States Patent [19]

Ball et al.

[11] Patent Number: 5,301,645

[45] Date of Patent: Apr. 12, 1994

[54] VEHICLE DRIVE ASSEMBLY WITH AUXILIARY ENGINE

[75] Inventors: Wilfried Ball, Dingolfing; Reinhold Ficht, Kirchseeon, both of Fed. Rep. of Germany

[73] Assignee: Bayerische Motoren Werke AG, Fed. Rep. of Germany

[21] Appl. No.: 784,432

[22] PCT Filed: Feb. 14, 1991

[86] PCT No.: PCT/EP91/00289

§ 371 Date: Jan. 6, 1992

§ 102(e) Date: Jan. 6, 1992

[87] PCT Pub. No.: WO91/14088

PCT Pub. Date: Sep. 19, 1991

[30] Foreign Application Priority Data

Mar. 9, 1990 [DE] Fed. Rep. of Germany ..... 4007438

[51] Int. Cl.[5] ..... F02B 77/00

[52] U.S. Cl. ..... 123/198 R; 123/DIG. 8

[58] Field of Search ..... 123/DIG. 8, 198 R

[56] References Cited

U.S. PATENT DOCUMENTS

| | | | |
|---|---|---|---|
| 3,865,195 | 2/1975 | Nelson . | |
| 4,531,379 | 7/1985 | Diefenthaler | 123/DIG. 8 |

FOREIGN PATENT DOCUMENTS

| | | |
|---|---|---|
| 0187930 | 7/1986 | European Pat. Off. . |
| 1751686 | 8/1971 | Fed. Rep. of Germany . |
| 4007438 | 3/1990 | Fed. Rep. of Germany . |
| 860006 | of 0000 | France . |
| 1463799 | 11/1966 | France . |
| WO91/13244 | 2/1991 | World Int. Prop. O. . |

*Primary Examiner*—Noah P. Kamen

*Attorney, Agent, or Firm*—Evenson, McKeown, Edwards & Lenahan

[57] ABSTRACT

A drive assembly, particularly for driving a vehicle, comprises a driving engine and an auxiliary engine as well as auxiliary assemblies which can be selectively driven by one of the engines. In a clear frontal area of the vehicle engine, a single-bank radial engine constructed as an internal-combustion engine is arranged as the auxiliary engine to save space. For achieving a compact, high-powered arrangement, the single-bank radial engine is constructed as a 4-cylinder 2-stroke engine with a crank guide power unit.

16 Claims, 1 Drawing Sheet

VEHICLE DRIVE ASSEMBLY WITH AUXILIARY ENGINE

BACKGROUND AND SUMMARY OF THE INVENTION

The present invention relates to a drive assembly, particularly for driving a vehicle, having a driving engine and an auxiliary engine as well as auxiliary assemblies driven by way of a clutch selectively by one of the engines.

French Patent Document FR-A-1 463 799 shows a drive assembly with a driving engine to which an auxiliary engine is assigned for the optional driving of auxiliary assemblies. The auxiliary engine which, if required, is used for driving the auxiliary assemblies is arranged laterally of the driving engine. The auxiliary assemblies are arranged at a distance from the clear frontal areas of both engines and constructionally are assigned essentially to the auxiliary engine. The considerable installation space is a disadvantage in this case.

The present invention is based on the object of providing, for a drive assembly, an arrangement of an auxiliary engine with a lower requirement with respect to installation space.

This object has been achieved according to the present invention in that a single-bank radial engine constructed as an internal-combustion engine is arranged as an auxiliary engine in a clear frontal area of the driving engine. Furthermore, a particularly space-saving arrangement is achieved by a single-bank radial engine which is constructed as a 4-cylinder 2-stroke engine with a crank guide power unit. By virtue of this single-bank radial engine which is described in detail, for example, in the European Patent EP-A-0 187 930, a short, compact and powerful auxiliary engine is achieved for a space-saving arrangement. However, the present invention is advantageous not only with respect to the overall size of the auxiliary engine. It also represents a considerable advantage with respect to the overall arrangement because of the fact that auxiliary assemblies may remain which are provided in the front-side end area of the driving engine and are arranged in order to utilize the given installation space. Thus, a separate arrangement which requires additional installation space is unnecessary.

The advantageous arrangement of the present invention is promoted in a simple manner in that the single-bank radial engine with the interposition of a shiftable clutch is arranged in alignment with a power unit shaft of the driving unit.

A further feature of the present invention achieves short overall length of the drive assembly in that, on the outer circumference, the clutch is in a rotating connection with output pulleys of enveloping gears provided in several planes in the clear frontal area of the driving engine for driving the auxiliary assemblies.

The above-described shiftable clutch may be configured such that by means of it, the auxiliary assemblies are optionally driven by the single-bank radial engine during stoppage, idling or possibly heavy loading of the driving engine. However, an operating method is also conceivable for the shiftable clutch in that, if required, only some of the auxiliary assemblies are driven by the single-bank radial engine. This applies particularly to the case in which one or several of these separately optionally driven auxiliary assemblies have to furnish an increased power which cannot be provided when the given rotational speed of the driving engine is maintained, such as an increased air-conditioning performance and/or an increased electric consumption from the wiring at a slow driving speed or a stop-and-go driving method of the vehicle.

In addition, the single-bank radial engine and the shiftable clutch can form a retrofit unit.

BRIEF DESCRIPTION OF THE DRAWINGS

These and further objects, features and advantages of the present invention will become more readily apparent from the following detailed description of a presently preferred embodiment when taken in conjunction with the accompanying drawings wherein.

DETAILED DESCRIPTION OF THE DRAWINGS

Figure 2:
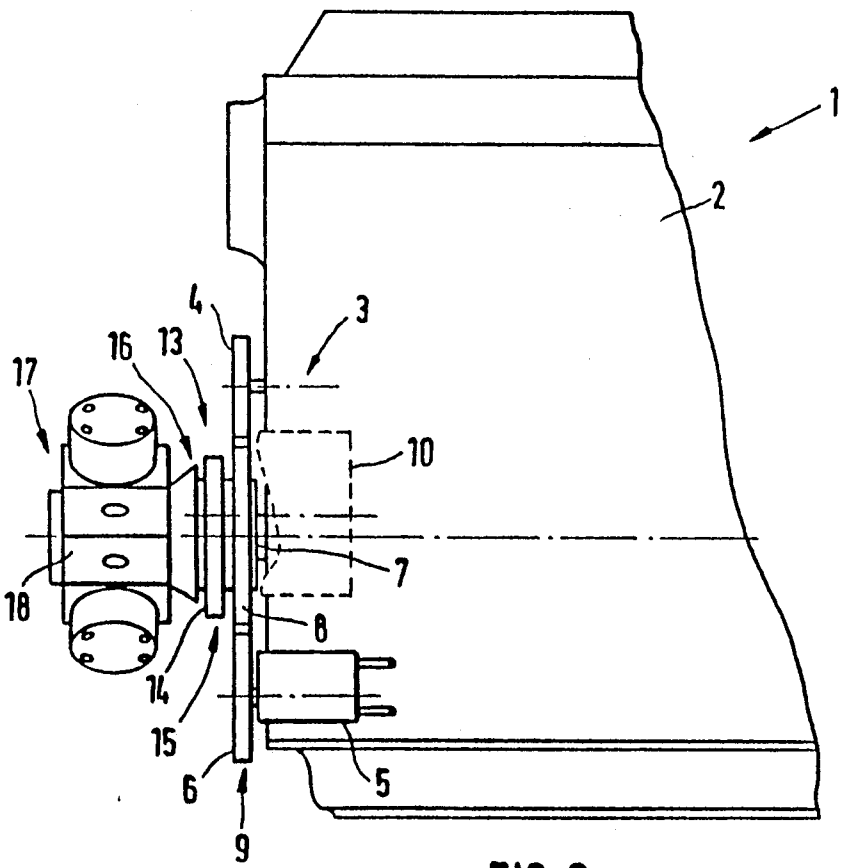
FIG. 2 is a partially lateral view of the drive assembly of FIG. 1.
Figure 1:
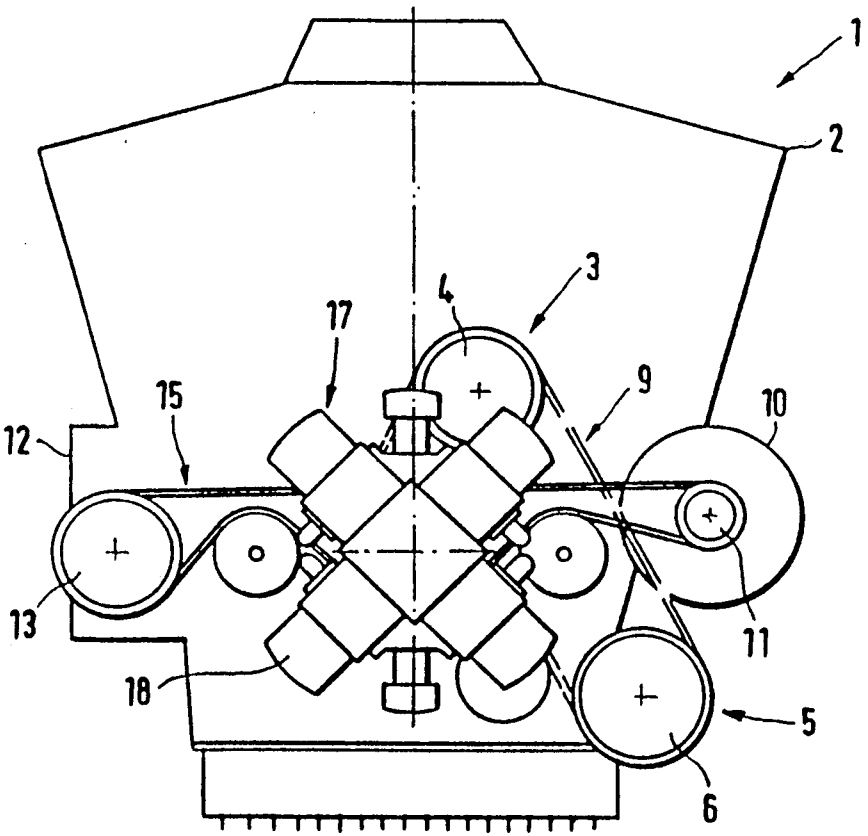
FIG. 1 is a frontal view of a drive assembly in accordance with the present invention.

An assembly 1 serving for driving a conventional vehicle (not shown) comprises a driving engine 2, which is used for driving the vehicle and has numerous auxiliary assemblies arranged in the front-side end area. The auxiliary assemblies are, for example, a coolant pump 3 with a driving pulley 4 and a power steering pump 5 with a driving pulley 6. Together with an output pulley 8 assigned to the power unit shaft or crankshaft 7 of the driving engine 2, the driving pulleys 4 and 6 are disposed in a plane of flexible transmitting device 9 in the form of, for example, a conventional toothed belt, chain and the like. Additional auxiliary assemblies are a generator 10 with a driving pulley 11 and an air-conditioning compressor 12 with a driving pulley 13 Together with another output pulley 14 assigned to the power unit shaft 7, the driving pulleys 11 and 13 are situated in another plane of a second enveloping drive train 15.

An auxiliary engine 17, which is used for the optional drive of the above-mentioned auxiliary assemblies 3, 5, 10, 12, is arranged in alignment with the power unit shaft 7 of the driving engine 2 with the interposition of a conventional clutch 16 which can be operator shifted or, in a known manner, shifted in response to selected ones of engine and vehicle parameters. 16. In order to achieve a short overall length of the drive assembly 1, the auxiliary engine 17, which is arranged in the clear frontal area of the driving engine 2, is constructed as a single-bank radial engine 18. In order to achieve, together with a space-saving arrangement, a short, compact and powerful auxiliary engine 17, the single-bank radial engine 18 is constructed as a 4-cylinder 2-stroke engine with a conventional scotch-yoke unit which converts reciprocating to rotary movement.

For the optional driving of the above-mentioned auxiliary assemblies 3, 5, 10, 12, the shiftable clutch 16, on the outer circumference, is non-rotatably connected with the output pulleys 8 and 14 of the enveloping power trains 9 and 15 of the auxiliary assemblies 3, 5 and 10, 12 divided into two groups. The clutch 16 can be shifted in that either both groups of auxiliary assemblies 3, 5 and 10, 12 or, as required, one of the groups 3, 5 or 10, 12 can be driven by the single-bank radial engine 18.

The single-bank radial engine 18 arranged on the driving engine 2 may also be equipped with the shiftable clutch 16 as a retrofit unit.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A vehicle drive assembly, comprising a driving engine, an auxiliary engine and auxiliary assemblies selectively driven by a shiftable clutch by one of the engines, wherein, in a clear frontal area of the driving engine, a single-bank radial engine configured as an internal-combustion engine is the auxiliary engine.

2. An assembly according to claim 1, wherein the single-bank radial engine is a 4-cylinder 2-stroke engine with a crank guide power unit.

3. An assembly according to claim 1, wherein the single-bank radial engine, with the interposition of a shiftable clutch, is aligned with a power unit shaft of the driving engine.

4. An assembly according to claim 3, wherein the single-bank radial engine is a 4-cylinder 2-stroke engine with a crank guide power unit.

5. An assembly according to claim 1, wherein an outer circumference of that the is rotatably connected with output pulleys of flexible transmitters provided in several planes in the clear frontal area of the driving engine for the driving of the auxiliary assemblies.

6. An assembly according to claim 5, wherein the single-bank radial engine is a 4-cylinder 2-stroke engine with a crank guide power unit.

7. An assembly according to claim 6, wherein the single-bank radial engine, with the interposition of a shiftable clutch, is aligned with a power unit shaft of the driving engine.

8. An assembly according to claim 1, wherein the single-bank radial engine, in additional to the driving of all auxiliary assembly by way of the shiftable clutch, is used for the selective driving of certain auxiliary assemblies.

9. An assembly according to claim 8, wherein the single-bank radial engine is a 4-cylinder 2-stroke engine with a crank guide power unit.

10. An assembly according to claim 9, wherein the single-bank radial engine, with tine interposition of a shiftable clutch, is aligned with a power unit shaft of the driving engine.

11. An assembly according to claim 10, wherein an outer circumference of the clutch is rotatably connected with output pulleys of flexible transmitters provided in several planes in the clear frontal area of the driving engine for the driving of the auxiliary assemblies.

12. An assembly according to claim 1, wherein the single-bank radial engine and the shiftable clutch constitute a unitary retrofit device.

13. An assembly according to claim 12, wherein the single-bank radial engine is a 4-cylinder 2-stroke engine with a crank guide power unit.

14. An assembly according to claim 13, wherein the single-bank radial engine, with the interposition of a shiftable clutch, is aligned with a power unit shaft of the driving engine.

15. An assembly according to claim 14, wherein an outer circumference of the clutch is rotatably connected with output pulleys of flexible transmitters provided in several planes in the clear frontal area of the driving engine for the driving of the auxiliary assemblies.

16. An assembly according to claim 15, wherein the single-bank radial engine, in addition to the driving of all auxiliary assemblies by way of the shiftable clutch, is used for the selective driving of certain auxiliary assemblies.

* * * * *